US006024306A

United States Patent [19]

Köppl et al.

[11] Patent Number: 6,024,306

[45] Date of Patent: Feb. 15, 2000

[54] DEVICE AND METHOD FOR FRAGMENTING SEMICONDUCTOR MATERIAL

[75] Inventors: Franz Köppl, Erlbach, Germany; Paul Fuchs, Mattighofen, Austria

[73] Assignee: Wacker-Chemie GmbH, Munich, Germany

[21] Appl. No.: 09/102,829

[22] Filed: Jun. 23, 1998

[30] Foreign Application Priority Data

Jun. 27, 1997 [DE] Germany ..... 197 27 441

[51] Int. Cl.[7] ..... B02C 19/18

[52] U.S. Cl. ..... 241/1; 241/301

[58] Field of Search ..... 241/1, 5, 23, 65, 241/66, 301

[56] References Cited

U.S. PATENT DOCUMENTS 4,540,127 9/1985 Andres ..... 241/1
4,653,697 3/1987 Codina ..... 241/1
4,871,117 10/1989 Bauereggger et al. ..... 241/1
5,464,159 11/1995 Wolf et al. ..... 241/1

FOREIGN PATENT DOCUMENTS 3811091 10/1989 Germany .
42-18-283 12/1993 Germany .
1741900 12/1990 U.S.S.R. .

*Primary Examiner*—Joseph J. Hail, III
*Assistant Examiner*—D. L. Cooke
*Attorney, Agent, or Firm*—Collard & Roe, P.C.

[57] ABSTRACT

A method and device for fragmenting semiconductor material, comprising at least two spaced-apart electrodes, which consist of the semiconductor material which is to be fragmented. Each electrode has a heating device. The electrodes pass high voltage current through the semiconductor material to fragment it. The device eliminates the risk of contanimation of the semiconductor material as compared with conventional methods.

19 Claims, 1 Drawing Sheet

DEVICE AND METHOD FOR FRAGMENTING SEMICONDUCTOR MATERIAL

BACKGROUND OF THE INVENTION

1. Field of the Invention

The invention relates to a device and a method for dividing or fragmenting semiconductor material. In particular, the invention relates to a method and device for fragmenting semiconductor material using electrodes made from the semiconductor material to be fragmented or reduced in size.

2. The Prior Art

High-purity semiconductor material is used to produce solar cells or electronic components, such as storage elements or microprocessors. The dopants that are introduced in a controlled manner are the only impurities that a material of this nature should contain. It is therefore desirable to keep the concentrations of harmful impurities as low as possible. It is often observed that even highly pure semiconductor material is re-contaminated during the course of further processing to give the end products. Thus, laborious purification steps are required again and again, in order to recover the original purity.

Atoms of foreign metals, which become incorporated into the crystal lattice of the semiconductor material, interfere with the charge distribution and may reduce the functioning of the subsequent component or cause it to fail. Consequently, contaminations of the semiconductor material by metallic impurities are especially hazardous. This applies especially to silicon, which is the most frequently used semiconductor material in the electronics industry. High-purity silicon is obtained by thermal decomposition of silicon compounds such as trichlorosilane, which are highly volatile and are therefore easily purified by distillation processes. In this process, the silicon is obtained as a polycrystalline material in the form of rods having typical diameters of from 70 to 300 mm and lengths of from 500 to 2500 mm.

A large proportion of the rods are used for the production of crucible-drawn single crystals, for strips and sheets or for the production of polycrystalline solar-cell base material. Since these products are produced from high-purity, molten silicon, it is necessary to melt solid silicon in crucibles. In order to make this process as effective as possible, large-volume, solid pieces of silicon, such as the polycrystalline rods mentioned above, must be cut up or fragmented prior to melting.

Conventionally, this always results in a superficial contamination of the semiconductor material, because the fragmentation is carried out with metal crushing tools, such as jaw crushers, rolling crushers, hammers or chisels.

When carrying out this fragmentation, careful attention should be paid to avoid contaminating the surfaces of the fragments with foreign materials. In particular, it is critical to avoid contamination from metal atoms, since these atoms can adversely alter the electrical properties of the semiconductor material. If the semiconductor material is fragmented using mechanical tools in the customary fashion, such as with steel crushers, then the fragments must subjected to a laborious and cost-intensive surface purification before being melted.

According to German Patent Application DE-38 11 091 A1 and its corresponding U.S. Pat. No. 4,871,117, it is possible to decompact solid, large-volume silicon bodies to accomplish fragmentation using tools whose operating surfaces are made of materials which do not entail contamination, or do so only to a minor extent, such as silicon, nitride ceramics or carbide ceramics. The decompacting is achieved by using heat to generate an external temperature gradient in the piece of silicon which is to be broken up and setting a surface temperature of from 400 to 1400° C., and then reducing this temperature quickly by at least 300° C., so that the temperature gradient is at least partially reversed.

In order to produce the temperature gradient, the solid material is introduced into a furnace and heated. However, this process has the drawback that foreign materials which have been adsorbed at the surface of the semiconductor material are set in motion and/or accelerated during the heating phase. In this way, the foreign materials pass from the surface into the crystal lattice of the semiconductor material, and hence evade cleaning measures, which are only able to remove impurities situated close to the surface. Moreover, it is virtually impossible in the abovementioned process to avoid contamination of the semiconductor material by foreign materials released from the furnace material during heating.

SUMMARY OF THE INVENTION

It is therefore an object of the invention to provide a device and a method which improve on the prior art and make it possible to fragment semiconductor material without contamination and without using high temperatures and mechanical crushing tools.

The invention comprises a device for fragmenting semiconductor material having at least two spaced-apart electrodes which consist of the semiconductor material which is to be fragmented. Each electrode has a heating device.

Surprisingly, it is possible to use electrodes made of semiconductor material, while electrodes made of a different material introduce considerable amounts of foreign material from the electrodes and/or from the water used for making contact.

The device according to the invention is preferably used to fragment hard brittle semiconductor material, such as germanium or gallium arsenide, and preferably silicon. It is irrelevant whether it is intended to fragment ready fragmented semiconductor material or semiconductor rods.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
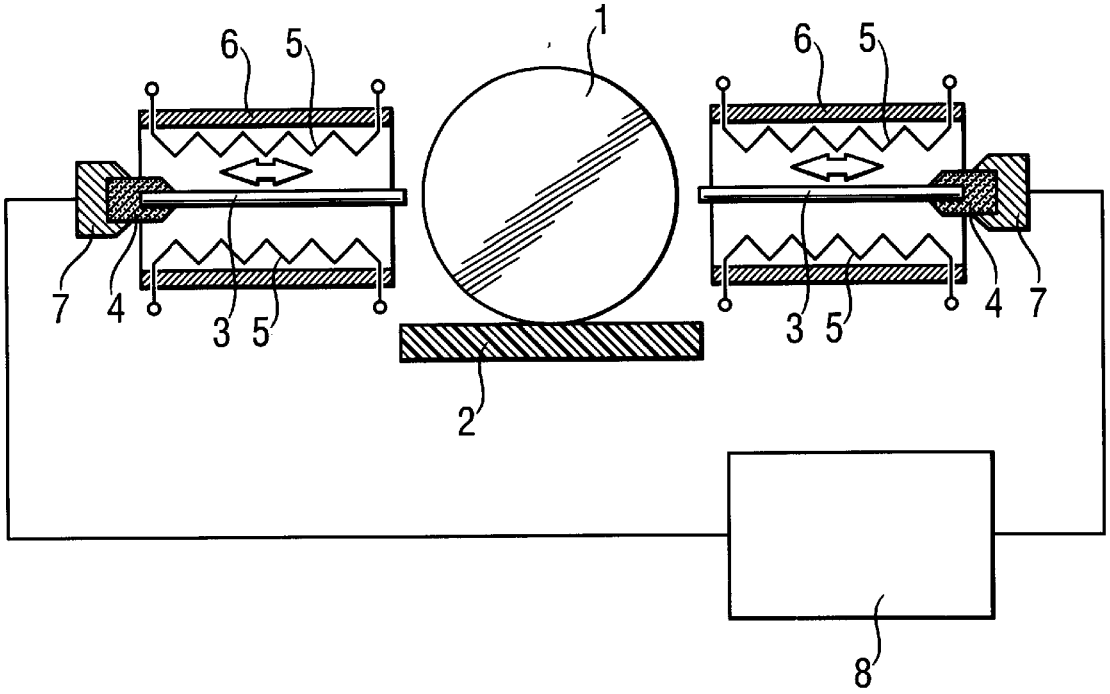
FIG. 1 shows a cross sectional view through a fragmentation device according to the invention.

Referring now in detail to the drawings and, in particular, FIG. 1 there is shown the device according to the invention, which comprises at least two spaced-apart electrodes 3, which consist of the semiconductor material 1 to be fragmented, which is germanium or gallium arsenide, and preferably silicon. The electrodes preferably have a diameter of from 6 mm to 20 mm, particularly preferably of from 8 mm to 12 mm. These electrodes have a heating device, which can heat them to temperatures of preferably from 400° C. to 1200° C. This heating device preferably has a heater cartridge 6 preferably containing electric heaters 5. Electrodes 3 themselves are preferably connected via a graphite electrode 4 to a high-voltage pulse generator 8. Preferably, electrodes 3 are movably connected, so that they can be pushed axially out of the heater cartridge 6 together with the electric heaters 5, and in this way can be pushed onto the semiconductor material to be fragmented, such as a silicon rod, so that they come into contact with the semiconductor material. The electrodes may also be movable, so that they are rigidly connected to the heating device and are moved together with the heating device on a displaceable mount 7, which is preferably made of metal.

A base 2, which is made of abrasion-resistant plastic or preferably of the semiconductor material to be fragmented, such as silicon, is situated between electrodes 3, in order to reduce contamination by foreign atoms. The device preferably operates under ambient air at normal pressure, but may also be operated in an atmosphere of increased breakdown strength, such as under elevated pressure or under an electronegative gas such as $CO_2$ or a mix of appropriate gases.

It is also possible to design the device using series of two mutually opposite electrodes 3, so that a rod made of semiconductor material can be fragmented in one operation. In this way, the electrodes may be arranged at distances of preferably 1 cm to 20 cm, depending on the length of the semiconductor material to be fragmented in a single operation.

The invention also comprises a method for fragmenting semiconductor material, wherein the material is fragmented by the direct passage of current comprising high-voltage pulses. The electrodes are made from the semiconductor material, and are brought to a temperature at which they are conductive.

Figure 2:
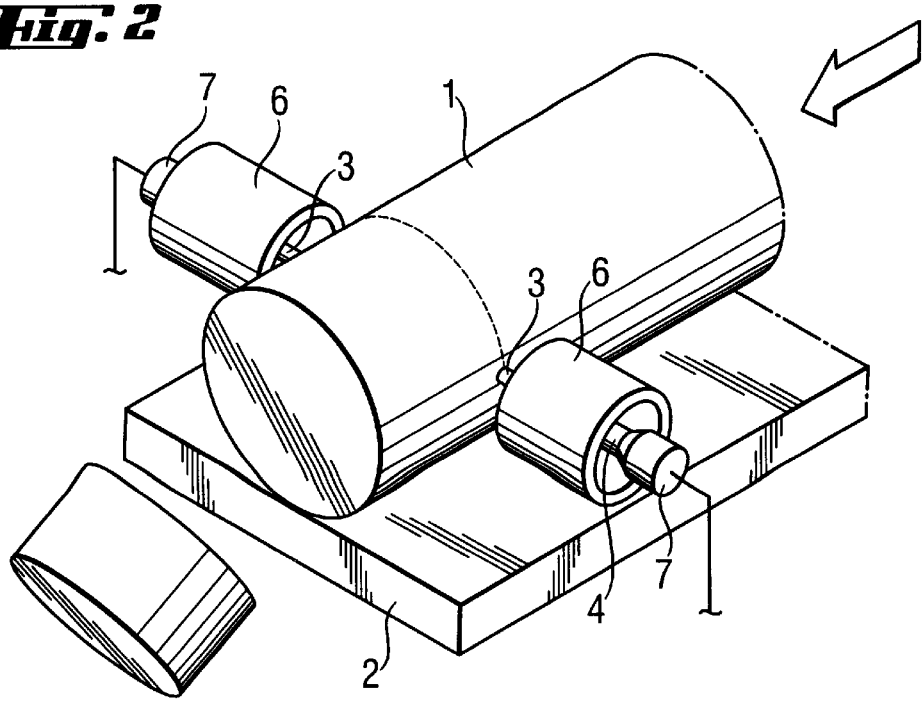
FIG. 2 shows a perspective view from above of the method according to the invention.

In the method according to the invention as shown in FIG. 2, which is preferably carried out using the device described above, semiconductor material 1, such as preferably germanium, gallium arsenide and in particular silicon, is pushed onto a base 2 that is preferably made or plastic or the semiconductor material, so that contamination with foreign atoms is reduced. In a preferred method, the rod-shaped semiconductor material 1 is preferably a silicon rod having a diameter of from 60 mm to 250 mm and a length of from 100 mm to 250 mm. The rod-shaped material 1 is pushed in steps onto the base 11 over intervals of preferably 1 cm to 20 cm, and preferably of from 3 cm to 8 cm. This also depends on how large the fragment is intended to be. This size can be set at any desired level from 5 mm to 180 mm.

Depending on the desired fragment size, the semiconductor material 1 is preferably pushed between 3 cm and 8 cm beyond at least two electrodes. The two electrodes 3 are then moved toward the semiconductor material 1, so that they come into contact therewith. Electrodes 3 consist of the semiconductor material to be fragmented and are provided with a heating device, which has a heater cartridge 6 and preferably an electric heater 5, which heats the electrodes to a temperature at which they are conductive. This temperature is preferably from 400° C. to 1200° C.

As soon as electrodes 3 are in contact with the semiconductor material 1, a high-voltage pulse generator 8 is used to generate at least one current surge, which preferably has a voltage of from 20 kV to 300 kV, and most preferably from 30 kV to 150 kV, a current intensity of from 1 kA to 20 kA, and most preferably from 3 kA to 10 kA, a pulse duration of from 10 nsec to 50 msec, and most preferably from 1 msec to 30 msec, and a pulse frequency of from 0.1 Hz to 10 Hz, most preferably of 0.5 Hz, given a rod diameter of 60 mm. The rod-shaped semiconductor material 1 is then advanced axially again by a corresponding distance and the procedure described above is repeated. The rod-shaped semiconductor material 1 can also be pushed into a device in which a series of two electrodes 3 are arranged at intervals of from 1 cm to 20 cm. The electrodes 3 simultaneously come into contact with the rod-shaped semiconductor material 1 in order to fragment it simultaneously by at least one current surge, as described above.

The method according to the invention can be used to fragment semiconductor material in polycrystalline and monocrystalline form.

An advantage of the method according to the invention is that it is possible to produce anything from large wafers to fine fragments, depending on the number of pulses, the voltage level, the pulse duration and the geometric distance between the contact points on the semiconductor material. Preference is given to a silicon fragment having a maximum dimension of 100 mm. Furthermore, the method according to the invention is cost-effective and extremely environmentally friendly, because no waste waters are produced.

Accordingly, while only a few embodiments of the present invention have been shown and described, it is obvious that many changes and modifications may be made thereunto without departing from the spirit and scope of the invention.

What is claimed is:

1. A device for fragmenting semiconductor material, comprising:

at least two spaced-apart electrodes made of the semiconductor material which is fragmented; and a heating device connected to each electrode and adapted to heat each electrode to a temperature at which the electrode becomes conductive, a high voltage pulse generator connected to each electrode for feeding high voltage pulses of current through semiconductor material fed between said electrodes, such that said semiconductor material fed between said electrodes is fragmented by said high voltage pulses from said electrodes.

2. The device according to claim 1, wherein the electrodes are made of silicon.

3. The device according to claim 1, wherein there are a series of spaced apart electrodes connected to a single high voltage pulse generator, so that semiconductor material fed between said electrodes is simultaneously fragmented in several places.

4. The device according to claim 1, wherein the heating device comprises a heater cartridge surrounding each electrode, said heater cartridge containing heating elements.

5. The device according to claim 4, wherein the electrodes are arranged along a common axis and are axially moveable with respect to each other.

6. The device according to claim 5, wherein the electrodes are rigidly connected to the heater cartridge so that the electrodes move axially with the heater cartridges.

7. The device according to claim 4, wherein the electrodes are movable with the electric heaters out of the heater cartridges.

8. The device according to claim 1, wherein the heating device heats each electrode to a temperature of from 400° C. to 1200° C.

9. The device according to claim 1, wherein the electrodes are mounted on a base made of the semiconductor material to be fragmented.

10. A method for fragmenting semiconductor material, comprising:

bringing electrodes made from the semiconductor material to be fragmented to a temperature at which the electrodes are conductive; and passing high-voltage pulses of current through said semiconductor material with said electrodes.

11. The method according to claim 10, wherein the electrodes are made of silicon.

12. The method according to claim 10, further comprising feeding the semiconductor material to be fragmented in between and beyond the electrodes so that the material is fragmented in a different place with each pulse of current.

13. The method according to claim 10, further comprising moving the electrodes toward the semiconductor material to be fragmented until the electrodes contact the semiconductor material prior to the step of passing high voltage current pulses through the material.

14. The method according to claim 10, wherein the electrodes are heated to a temperature of from 400° C. to 1200° C.

15. The method according to claim 10, wherein the high voltage current pulses have a voltage of from 20 kV to 300 kV.

16. The method according to claim 10, wherein the high voltage current pulses have a pulse duration of from 10 nsec to 50 nsec.

17. The method according to claim 10, wherein the high voltage current pulses have a current intensity of from 1 kA to 20 kA.

18. The method according to claim 10, wherein the high voltage current pulses have a pulse frequency of from 0.1 Hz to 10 Hz.

19. The method according to claim 10, wherein there are at least two pairs of opposing electrodes and wherein each pair simultaneously passes high voltage current pulses through the semiconductor material to be fragmented so that the material is simultaneously fragmented in at least two places.

* * * * *